US005890255A

United States Patent [19]

Robinson

[11] Patent Number: 5,890,255

[45] Date of Patent: Apr. 6, 1999

[54] STA-CLEAN-NET CLEANING AND GROOMING ATTACHMENT

[76] Inventor: Lisa Farmonia Robinson, 2516 Navasota Cir., Fort Worth, Tex. 76131

[21] Appl. No.: 490,915

[22] Filed: Jun. 19, 1995

[51] Int. Cl.[6] ..... A46B 17/06; A45D 24/42

[52] U.S. Cl. ..... 15/246; 15/104.94; 15/169; 119/628; 132/110; 132/119

[58] Field of Search ..... 15/104.94, 142, 15/168–170, 246; 119/628, 629; 132/108–111, 119

[56] References Cited

U.S. PATENT DOCUMENTS 1,249,334 12/1917 Colchin ..... 132/119
1,794,754 3/1931 Burkhart ..... 132/119 X
2,437,298 3/1948 Heyman ..... 132/119 X
2,553,242 5/1951 Dombitsky ..... 15/246

FOREIGN PATENT DOCUMENTS 364548 11/1922 Germany ..... 132/119

*Primary Examiner*—Mark Spisich
*Attorney, Agent, or Firm*—Law Office Jasper C. Rowe; Jasper C. Rowe

[57] ABSTRACT

An attachment for quickly, easily, inexpensively and efficiently cleaning brushes, combs, or other cleaning and grooming implements is disclosed which removes built-up dirt, lint, hair, and other unwanted foreign material which has been deposited by use of the implement near the base of toothed and bristled cleaning and grooming implements.

8 Claims, 5 Drawing Sheets

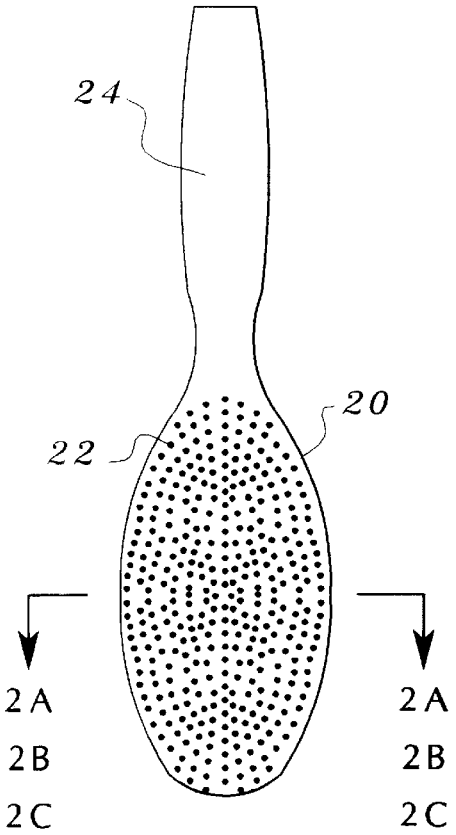
Fig. 1
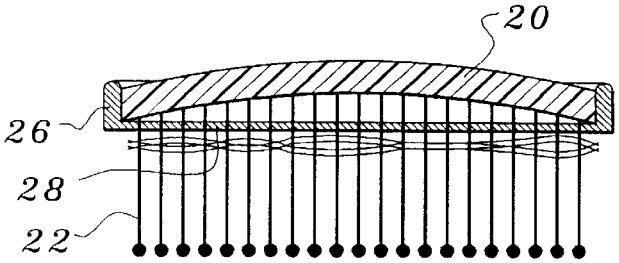
Fig. 2A
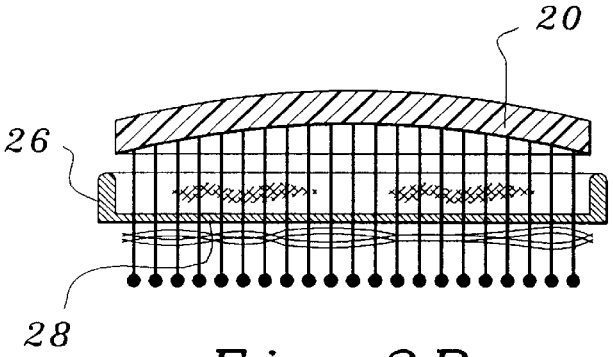
Fig. 2B
Fig. 2C
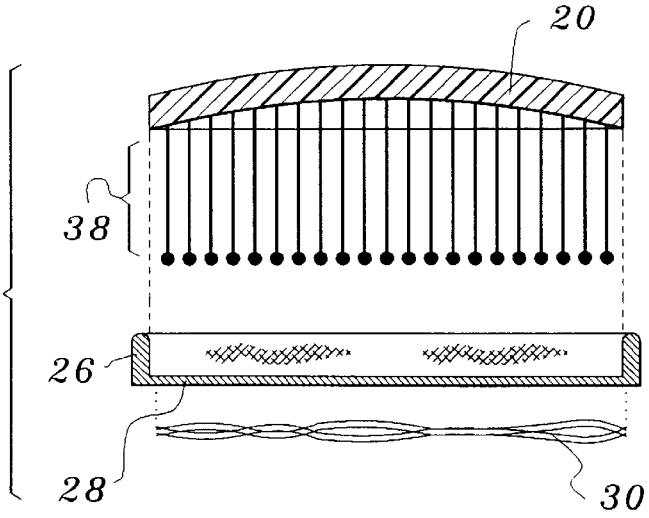

STA-CLEAN-NET CLEANING AND GROOMING ATTACHMENT

TECHNICAL FIELD

This invention relates in general to attachments for brushes, combs, and other grooming and cleaning implements, and more particularly to novel attachments for hair grooming implements of the nature of combs, brushes, and the like.

BACKGROUND OF THE INVENTION

Conventionally, in the past, while using combs or brushes, during combing or brushing operations, a large amount of dirt, lint, or other foreign material collects on the base of the bristles of the brush or on the comb at the base of and between the teeth of the comb.

In the past, combs, brushes or other grooming or cleaning implements had to be washed or otherwise cleaned by combing the foreign material from the brush or brushing the foreign material from the comb or by immersing the comb, brush or grooming utensil in water or other cleaning solution. This cleaning was almost always a task which was deemed to be time consuming, unpleasant and thus was often avoided, causing the utensils to become dirty, germ laden and a safe harbor for the transmission of disease germs or parasites.

The present invention seeks to provide a novel simple, inexpensive, easily used attachment for cleaning and grooming implements which retards or prevents the deposit and build-up of dirt, lint, or other unwanted foreign material at the base of and between the bristles of a brush and at the base of and between the teeth of a comb or other cleaning or grooming implement which are deposited by use of the implement.

SUMMARY OF THE INVENTION

The present invention relates to attachments for cleaning brushes, combs and other cleaning or grooming implements in order to allow the quick and easy removal of the resultant build-up of dirt, lint, and other foreign material near the base of toothed and bristled cleaning, grooming implements caused by use of the implements.

Generally, in all embodiments, the structure of the present invention is comprised of at least one durable, elastic, tensioning, securing, surround collar in the form of a band and about which fits around the sides of the base or shank or cleaning and grooming member support surface of the operating area of said brush, comb, or other implement, thereby securing said attachment to said implement; and at least one layer of woven or unwoven large pore or aperture elastic protective barrier material which is attached to only one edge of said collar along its entire circumference and periphery and which lies more or less flat against said base or shank of said brush, comb, or other cleaning or grooming implement, thereby allowing the teeth, bristles, or other projections to create and expand and thus project through the created apertures or voids in the material which subsequently close up tightly against said projections in order to create a barrier between said base or shank of said implement to catch and retain said dirt, lint, hair and other built-up foreign materials which are deposited by use of said implement, thereby, allowing said trapped built-up dirt, lint, hair and other foreign materials to be readily and easily removed when said attachment is removed from said implement.

In one preferred embodiment of the present invention, the invention also contains a chemical impregnating ingredient, such as an antiseptic, hair-color, hair-conditioner, or hair growth formula for application to the hair, item to be cleaned or groomed, or to the cleaning or grooming implement.

BRIEF DESCRIPTION OF THE DRAWINGS

For a more complete understanding of the present invention and for further advantages thereof, reference is made to the following descriptions of the preferred embodiments taken in conjunction with the accompanying drawings, in which:

Closely related figures have the same number but different alphabetic suffixes.

FIG. 1 shows a bottom view elevation of the attachment of the present invention as applied to as brush, the view being taken along a line of sight from the bottom perpendicular to the back of the brush.

FIG. 2A shows a section view of the attachment of the present invention, as applied to a brush, when the invention is in place against the base of the head of the brush, the section being taken along line 2A,2B,2C–2A,2B,2C and in the direction perpendicular to line 2A,2B,2C–2A,2B,2C of FIG. 1, in the direction indicated by the arrows.

FIG. 2B shows a section view of the attachment of the present invention, as applied to a brush, when the invention is partially in place and being removed from its position against the base of the head of the brush, the section being taken along line 2A,2B,2C–2A,2B,2C of FIG. 1, and in the direction perpendicular to line 2A,2B,2C–2A,2B,2C in the direction indicated by the arrows.

FIG. 2C shows a section view of the attachment of the present invention, as applied to a brush, after the invention has just been removed from its position against the base of the head of the brush, showing the foreign material being removed from the brush, the section being taken along line 2A,2B,2C–2A,2B,2C of FIG. 1, and in the direction perpendicular to line 2A,2B,2C–2A,2B,2C in the direction indicated by the arrows.

Reference Numerals in Drawings

Figure 2D:
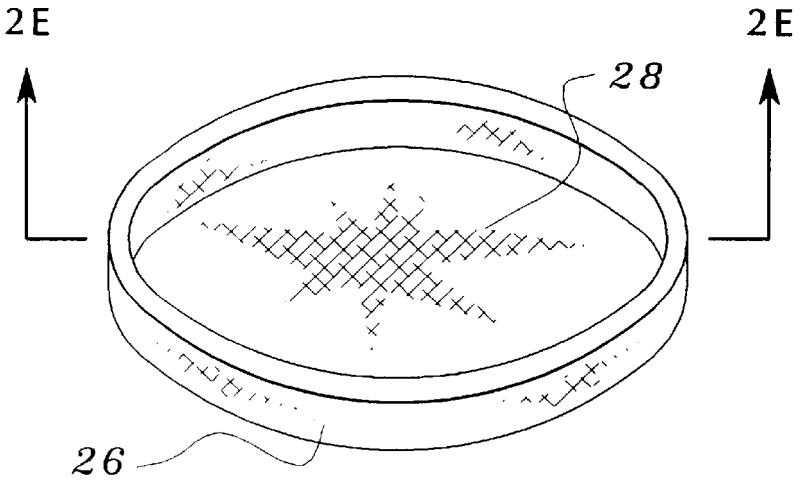
FIG. 2D shows a perspective view of the attachment of the present invention when it is removed from the cleaning or grooming brush.
Figure 2E:
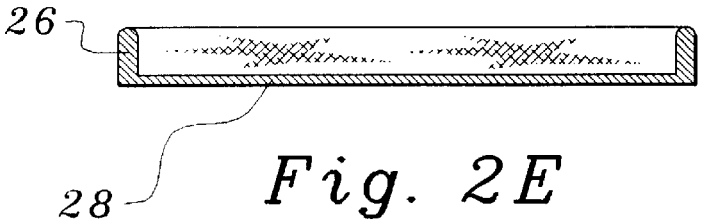
FIG. 2E shows a section view of the attachment of the present invention, as applied to a brush, after the invention has just been removed from the brush, the section being taken along line 2E—2E of FIG. 2D, and in the direction perpendicular to line 2E—2E in the direction indicated by the arrows.
Figure 5A:
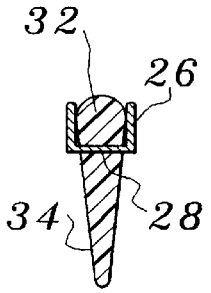
FIG. 5A shows a section view of the attachment of the present invention as applied to a comb with the invention securely in place in Its operating position against the shank of the comb, the section being taken along line 5A—5A of FIG. 4A, and in the direction perpendicular to line 5A—5A in the direction indicated by the arrows.
Figure 5C:
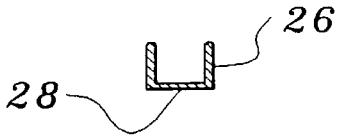
FIG. 5C shows a section view of the attachment of the present invention as applied to a comb with the invention totally removed from its operating position against the shank of the comb, the section being taken along line 5C—5C of FIG. 4C, and in the direction perpendicular to line 5C—5C in the direction indicated by the arrows.

20. Base of Head of Brush
22. Bristles of Brush
24. Handle of Brush
26. Durable elastic, tensioning, securing surround collar
28. Elastic, woven or unwoven large pore or aperture, protective material layer
30. Dirt, lint, hair, or other foreign material which has been removed from the implement
32. Shank of comb
34. Teeth of comb
36. Secondary, durable, tensioning, securing, surround collar
38. Operating area of brush
40. Operating area of comb

DESCRIPTION OF THE PREFERRED EMBODIMENTS

Referring to the FIGS., like reference numbers indicate the same elements in the different views of the invention. In FIGS. 1, and 2A–2E the base of the head of the brush is generally identified by the reference number (20). Note that the drawings are not to scale.

FIG. 1 illustrates one embodiment of the present invention.

Figure 4A:
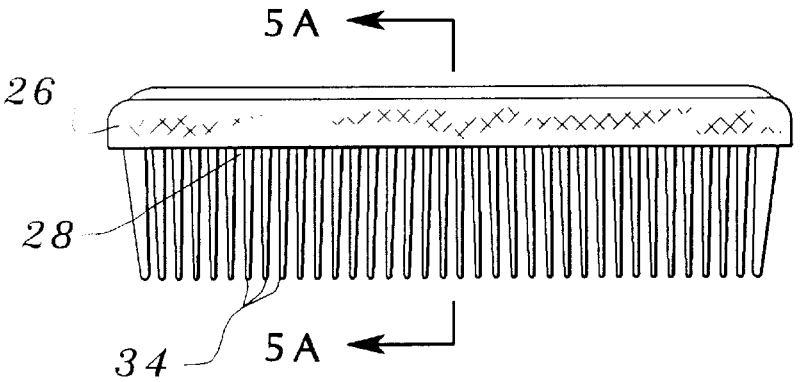
FIG. 4A shows a frontal isometric view of the attachment of the present invention as applied to a comb with the invention securely in place in its operating position against the shank of the comb.
Figure 4:
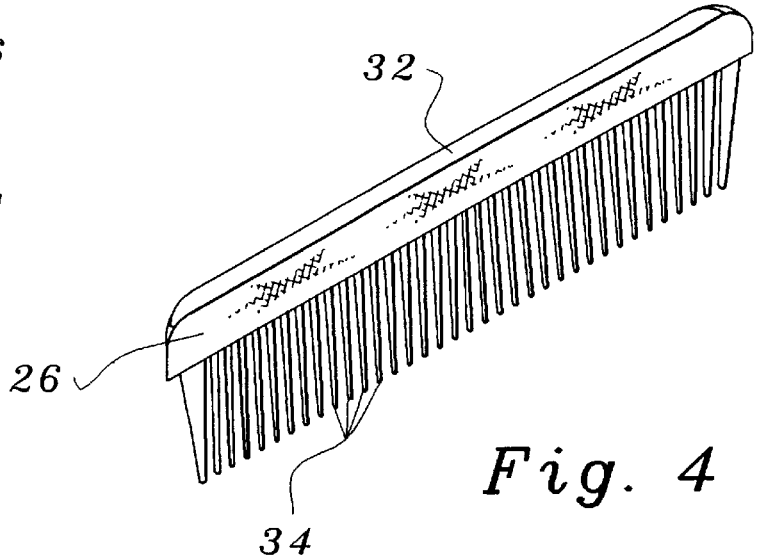
FIG. 4 shows a perspective view of the attachment of the present invention as applied to a comb with the invention securely in place in its operating position against the shank of the comb.

FIG. 4 illustrates one embodiment of the present invention.

Figure 6A:
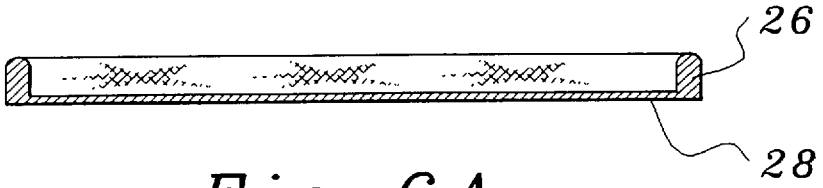
FIG. 6A shows a section view of one preferred embodiment of the attachment of the present invention in which the collar is comprised of a single or multi-layer single material durable, elastic, tensioning securing, surround, collar as applied to a comb with the invention totally removed from its operating position against the shank of the comb, the section being taken along line 6A,6B,6C,6D–6A,6B,6C,6D of FIG. 4C, and in the direction perpendicular to line 6A,6B,6C,6D–6A,6B,6C 6D in the direction indicated by the arrows.

FIG. 6A illustrates one embodiment of the present invention.

Figure 6B:
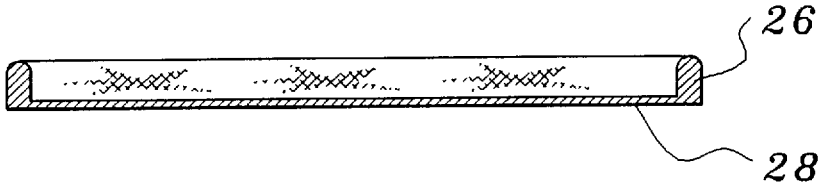
FIG. 6B shows a section view of one preferred embodiment of the attachment of the present invention in which the collar is comprised of a rubber or other elastic impregnated material durable, elastic, tensioning securing, surround, collar as applied to a comb with the invention totally removed from its operating position against the shank of the comb, the section being taken along line 6A,6B,6C,6D–6A,6B,6C, 6D of FIG. 4C, and in the direction perpendicular to line 6A,6B,6C,6D–6A,6B,6C,6D in the direction indicated by the arrows.

FIG. 6B illustrates one embodiment of the present invention.

Figure 6C:
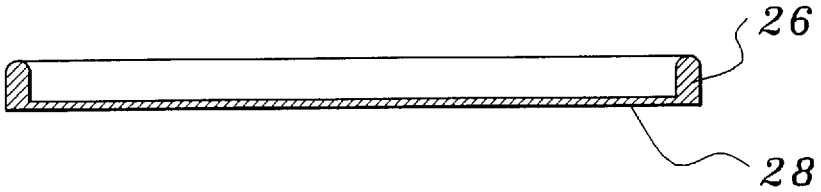
FIG. 6C shows a section view of one preferred embodiment of the attachment of the present invention in which the collar is comprised of a plastic or other heat shrink impregnated material durable, elastic, tensioning securing, surround, collar as applied to a comb with the invention totally removed from its operating position against the shank of the comb, the section being taken along line 6A,6B,6C, 6D–6A,6B,6C,6D of FIG. 4C, and in the direction perpendicular to line 6A,6B,6C,6D–6A,6B,6C,6D in the direction indicated by the arrows.

FIG. 6C illustrates one embodiment of the present invention.

Figure 6D:
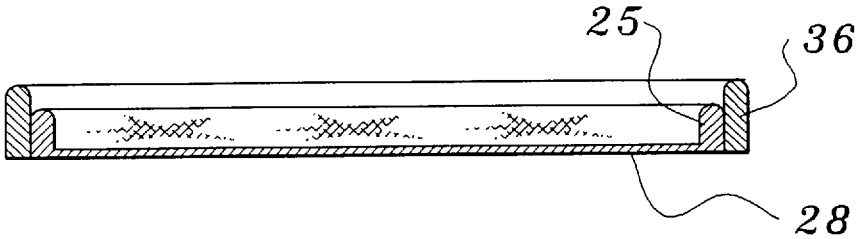
FIG. 6D shows a section view of one preferred embodiment of the attachment of the present invention in which the collar is comprised of a multiply applied part material in order to constitute a durable, elastic, tensioning securing, surround, collar as applied to a comb with the invention totally removed from its operating position against the shank of the comb, the section being taken along line 6A,6B,6C, 6D–6A,6B,6C,6D of FIG. 4C, and in the direction perpendicular to line 6A,6B,6C,6D–6A,6B,6C,6D in the direction indicated by the arrows.

FIG. 6D illustrates one embodiment of the present invention.

Referring to the figures generally and in particular to FIGS. 1–6D, there are illustrated several preferred embodiments of the present invention which is an attachment and method for easily and efficiently cleaning brushes, combs, or other cleaning and grooming implements Is disclosed which removes built-up dirt, lint, hair, and other unwanted foreign material which has been deposited by use of the implement near the base of toothed and bristled cleaning and grooming implements.

In all embodiments, the objective of the invention is to prevent the build-up of unwanted foreign material, such as dirt, lint, and hair which are deposited on a cleaning and grooming member support surface by use of combs, brushes and other cleaning and grooming implements, by providing an inexpensive, quick and easy method for easily and efficiently cleaning brushes, combs, or other cleaning and grooming implements by use of a novel attachment which removes built-up dirt, lint, hair, and other foreign material which has been deposited by use of the cleaning and grooming implement near the base of toothed and bristled cleaning and grooming implements.

Generally, in all embodiments, the structure of the present invention is comprised of at least one durable, elastic, tensioning, securing, surround collar (26) which fits around the sides of the base (20) or shank (32) of the operating areas (38) and (40) of said brush, comb, or other implement, thereby securing said attachment to said implement; and at least one layer of open weave woven or unwoven large pore or aperture protective barrier material (28) which is attached to only one edge of said collar (26) along its entire circumference and which lies more or less flat against said cleaning and grooming member support surface such as the base (20) or shank (32) of said brush, comb, or other cleaning and grooming implement, thereby allowing the cleaning and grooming projections such as the teeth (34), bristles (22), or other projections to create and expand and thus project through the created apertures or voids in the material (28) which subsequently close up tightly against said projections in order to create a barrier between said base (20) or shank (32) of said implement to catch and retain said dirt, lint, hair and other unwanted built-up foreign materials (30) which are deposited by use of said implement, thereby, allowing said trapped built-up dirt, lint, hair and other foreign materials (30) to be readily and easily removed when said attachment is removed from said implement.

In one preferred embodiment of the present invention, the invention also contains a chemical impregnating ingredient, such as an antiseptic, hair-color, hair-conditioner, or hair growth formula for application to the hair, item to be cleaned or groomed, or to the implement.

Figure 3:
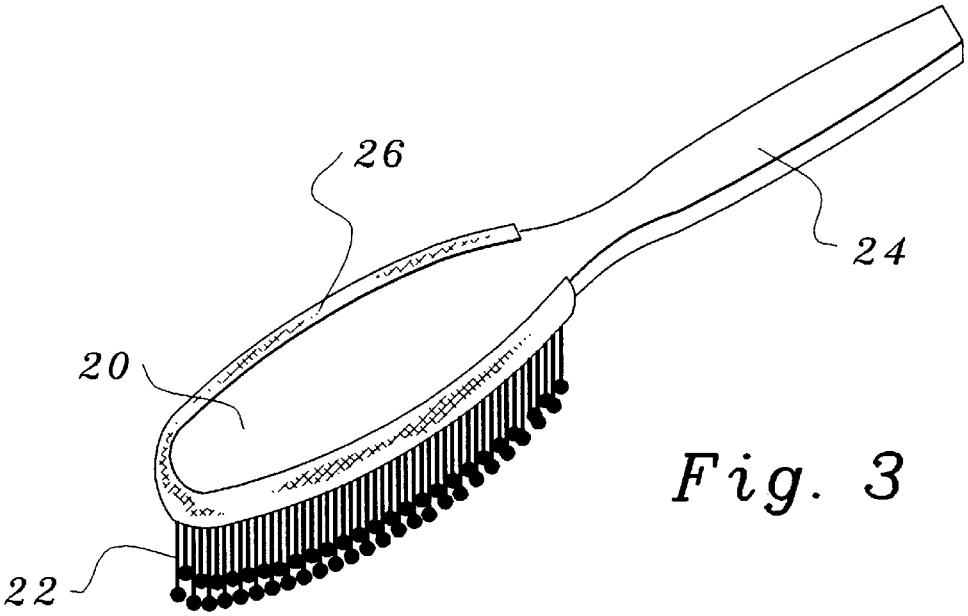
FIG. 3 shows a perspective view of the attachment of the present invention as applied to a brush implement.
Figure 4B:
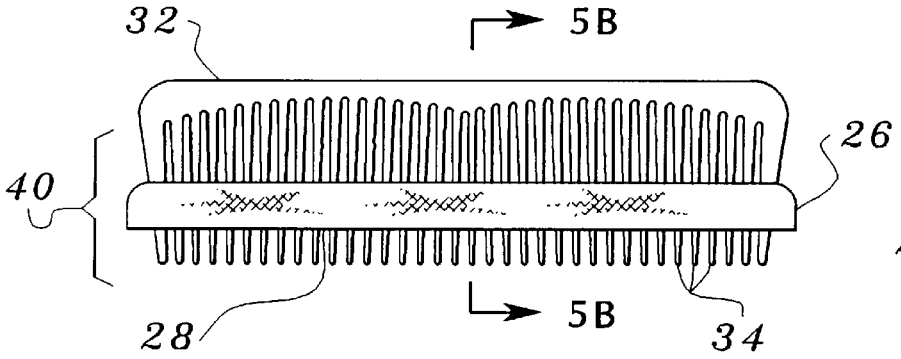
FIG. 4B shows a frontal isometric view of the attachment of the present invention as applied to a comb with the invention being partially removed from its operating position against the shank of the comb.
Figure 5B:
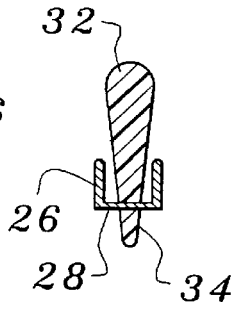
FIG. 5B shows a section view of the attachment of the present invention as applied to a comb with the invention partially removed from its operating position against the shank of the comb, the section being taken along line 5B—5B of FIG. 4B, and in the direction perpendicular to line 5B—5B in the direction indicated by the arrows.
Figure 4C:
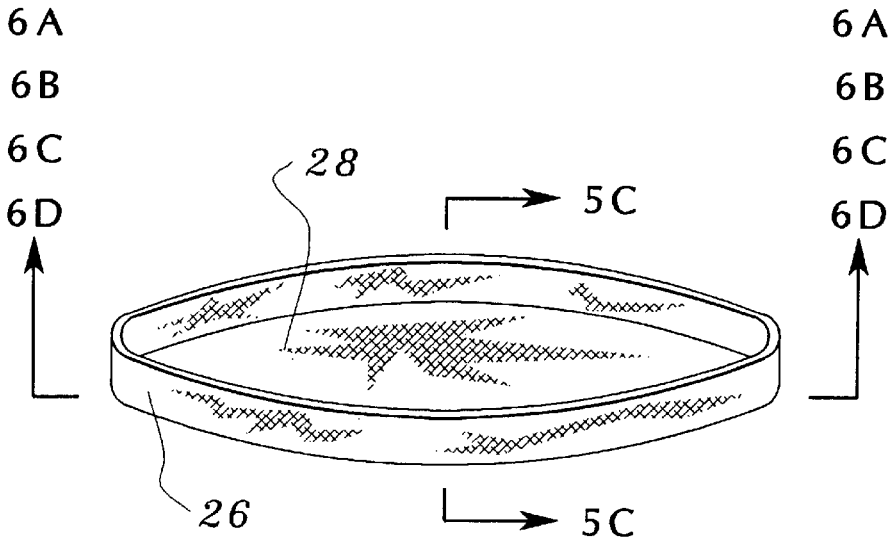
FIG. 4C shows a perspective view of the attachment of the present invention as applied to a comb with the invention being completely removed from its operating position against the shank of the comb.

FIG. 3 illustrates one preferred embodiment of the present invention, when attached to the intended cleaning and grooming implement in its intended functioning position.

FIG. 4 illustrates one preferred embodiment of the present invention, when attached to the intended cleaning and grooming implement in its intended functioning position.

FIG. 6A illustrates one embodiment of the present invention, when removed from the intended cleaning and grooming implement, wherein the durable, elastic, tensioning surround collar (26) is comprised of a single or multiple layer single material, which has the elastic woven or unwoven large pore or aperture protective barrier layer material (28) attached to its entire circumference.

The elastic, tensioning, surround collar (26) can be comprised of mesh, terry-cloth, or other durable elastic material. It can also be silk, NYLON or ORLON or brands of synthetic materials other synthetic or natural materials and can be made of knit, mesh, woven or unwoven elastic material.

FIG. 6B illustrates a second embodiment of the present invention, when removed from the intended cleaning and grooming implement, wherein the durable, elastic, tensioning surround collar (26) is comprised of a rubber or other elastic impregnated material, which has the elastic woven or unwoven large pore or aperture protective barrier layer material (28) attached to its entire circumference of the surround collar.

FIG. 6C illustrates a third embodiment of the present invention, when removed from the intended cleaning and grooming implement, wherein the durable, elastic, tensioning surround collar (26) is comprised of a plastic or other heat shrink impregnated material, which has the elastic woven or unwoven large pore or aperture protective layer material (28) attached to its entire circumference.

FIG. 6D illustrates a fourth embodiment of the present invention, when removed from the intended cleaning and grooming implement, wherein the durable, elastic, tensioning surround collar (26) is comprised of a multiple part applied material, which has the elastic woven or unwoven large pore or aperture protective barrier layer material (28) attached to its entire circumference of the surround collar.

In operation in all embodiments of the present invention, the attachment operates to clean brushes combs or other cleaning and grooming implements by use of an inexpensive attachment which operates to quickly, easily, efficiently and inexpensively remove built-up dirt, lint, hair and other foreign material which has been deposited by use near the base of toothed and bristled cleaning and grooming implements (20) by forcing the teeth (34) bristles (22), or other projections through at least one layer of elastic woven or unwoven large aperture protective material (28) in order to create and expand voids or apertures in the material (28), which subsequently close tightly against the projections, in order to create a barrier between the base (20) or shank (32) of said cleaning and grooming implement. Next, in operation of the attachment, the attachment is secured to the implement by at least one durable elastic tensioning, securing, surround collar (26) which has said layer of open weave woven or unwoven large aperture protective material (28) attached to perphecy of said collar (26) along its entire circumference, which secures the attachment to the sides of the base (20) or shank (32) of the operating area of said brush, comb, or other implement (38) and (40). Finally, in operation the attachment, is used by removing, said attachment from said implement, thereby causing said dirt, lint, hair and other foreign material (30), which was deposited by use of said implement to be removed from said implement.

The large aperture protective barrier material (28) can be comprised of silk, NYLON, or ORLON brands of synthetic materials, therefore or like elastic synthetic or natural materials. It can also be comprised of knit, mesh, or other open weave woven, or unwoven, elastic materials such as terry-cloth or like material.

It should be noted that the present invention can be an inexpensive disposable article of manufacture.

Thus the scope of the invention should be determined by the appended claims and legal equivalents, rather than by the examples given.

I claim:

1. A cleaning attachment adapted for use with a cleaning and grooming implement of the type having a cleaning and grooming member support surface from which project a plurality of cleaning and grooming projections, said cleaning attachment comprising:

an elastic surround collar in the form of a band which is adapted to fit around and about side portions of said cleaning and grooming member support surface, thereby securing said cleaning attachment to said cleaning and grooming implement, said elastic collar having upper and lower edges extending about the periphery thereof;

a layer of elastic protective barrier material attached to only one of said edges of said collar along the entire periphery of said collar, said layer of elastic material including means for permitting the cleaning and grooming projections of the cleaning and grooming implement to pass there through; and the layer of elastic protective barrier material, when the cleaning attachment is attached to the cleaning and grooming implement, being adapted to be positioned closely adjacent to said cleaning and grooming member support surface and said cleaning and grooming projections which is adapted to catch and retain debris and foreign materials which are deposited by use of said cleaning and grooming implement, said debris and foreign materials being readily and easily removed from said cleaning implement when said cleaning attachment is removed therefrom.

2. The cleaning attachment of claim 1, wherein said elastic surround collar is comprised of at least one layer selected from the group consisting of mesh, terry cloth, and any durable, elastic material.

3. The cleaning attachment of claim 1, wherein said elastic surround collar is comprised of rubber-like elastic impregnated material.

4. The cleaning attachment of claim 1, wherein said elastic surround collar is comprised of a plastic heat shrink material.

5. The cleaning attachment of claim 1, wherein said elastic surround collar is comprised of a multiple-part assembly, comprised of an inner collar of elastic mesh material and a second collar of plastic heat shrink material.

6. The cleaning attachment of claim 1, wherein said layer of elastic protective barrier material being selected from the group consisting of mesh, terry cloth, and any durable, large pore and aperture, elastic protection material.

7. The cleaning attachment of claim 1, wherein said layer of elastic protective barrier material is comprised of elastic open-weave terry-cloth.

8. The attachment of claim 1, wherein said layer of elastic protective barrier material is further comprised of a chemical impregnating ingredient, selected from the group consisting of antiseptics, hair-coloring, hair-conditioners, cleaners, and hair growth formula for application to the item to be cleaned and groomed and for application to the cleaning and grooming implement.

* * * * *